United States Patent [19]

Newcomb

[11] 3,947,794

[45] Mar. 30, 1976

[54] MAGNETIC CORE ASSEMBLIES WITH ADJUSTABLE RELUCTANCE AS A FUNCTION OF TEMPERATURE

[75] Inventor: Clive Victor Newcomb, Salford, England

[73] Assignee: U.S. Philips Corporation, New York, N.Y.

[22] Filed: Feb. 10, 1975

[21] Appl. No.: 548,437

Related U.S. Application Data

[63] Continuation of Ser. No. 417,548, Nov. 20, 1973.

[30] Foreign Application Priority Data

Dec. 11, 1972 United Kingdom ..... 57060/72

[52] U.S. Cl. ..... 335/217; 336/179

[51] Int. Cl.[2] ..... H01F 1/00

[58] Field of Search ..... 336/83, 179; 335/217

[56] References Cited

UNITED STATES PATENTS

| | | | |
|---|---|---|---|
| 3,028,570 | 4/1962 | Taylor | 336/179 X |
| 3,195,086 | 7/1965 | Taylor | 336/179 X |
| 3,663,913 | 5/1972 | Kato et al. | 336/179 |

FOREIGN PATENTS OR APPLICATIONS

| | | | |
|---|---|---|---|
| 1,364,128 | 5/1964 | France | 336/83 |

*Primary Examiner*—G. Harris

*Attorney, Agent, or Firm*—Frank R. Trifari; Bernard Franzblau

[57] ABSTRACT

A metal strip on a magnetic core body, provided with an air gap, for a coil means, is connected to a surface of the magnetic material such that an assembly similar to a bimetal is formed. Variations in temperature then cause variations of the length of the air gap.

10 Claims, 9 Drawing Figures

MAGNETIC CORE ASSEMBLIES WITH ADJUSTABLE RELUCTANCE AS A FUNCTION OF TEMPERATURE

Figure 1:
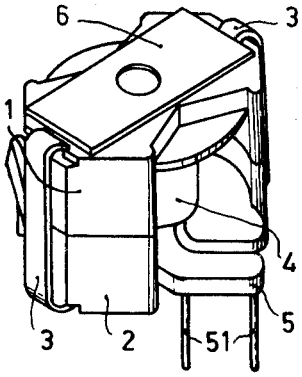

This is a continuation of application Ser. No. 417,548, filed Nov. 20, 1973.

The invention relates to a core body for a coil or transformer, comprising a core consisting of two core parts of ferromagnetic material which are fixed together such that an air gap is defined between two surfaces of the core parts, said core being connected to a non-magnetic element having a temperature coefficient which differs from that of the core material, said element being arranged such that the resulting different coefficients of expansion cause a variation of the length of the air gap and adjust the reluctance of the core as a function of the temperature.

The magnetic material may be a suitable magnetic alloy or ferrite, and is usually formed to hollow-shaped bodies for the core parts. Each core part comprises a central tubular portion which is enclosed by one or more coil windings and which is connected to a concentric outer wall by way of an integrally formed end wall. The outer wall is normally slotted to provide an outlet for leading out the ends of the coil windings.

Two core parts are joined such that they enclose a coil winding which may be arranged on a coil form. The core parts are fixed in this position by an adhesive or clamp arrangement, and the ends of the coil windings are connected to a tag board. The resulting inductive component can be very readily assembled, and it has a compact shape and good magnetic screening.

To enable the reluctance of the magnetic circuit formed by the two core parts to be adjusted, one of the tubular portions may be ground back along its axis so that in the resulting magnetic circuit an air gap will be produced.

The length of the air gap can be determined roughly by the grinding process during manufacture of the core. However, to enable an adjustment of the assembled core to be effected, a tube of magnetic material which acts as a partial magnetic shunt is inserted in a central opening of the core and located across the air gap. The tube is held in a cylindrical carrier and can be moved by a screwing action along the axis of the core. This movement of the tube relative to the air gap thus enables the effective length of the gap to be varied in a reliable and stable manner.

Where a ferrite material is used for a core which has an air gap, it is usual to assume that the following theoretical formula applies: temperature coefficient of inductance of the gapped core assembly = normalised material temperature coefficient $x$ effective permeability of the core.

The temperature coefficient of inductance is usually positive for a ferrite core and it is comparatively large both in value and tolerance. For example, the normalised material temperature coefficient is commonly 0.5 to $1.5 \times 10^{-6}$°C$^{-1}$, (parts per million per degree centigrade), and taking an effective permeability of 100, it is seen that the temperature coefficient of inductance of the gapped core assembly may vary from 50 to 150 ppm °C$^{-1}$ (parts per million per degree centigrade).

In a tuned circuit comprising a ferrite core coil and resonating capacitor it is necessary to compensate for the positive temperature coefficient of the coil with an additional capacitor having a negative temperature coefficient.

| Component | | | Contribution to tuned circuit temperature coefficient ppm °C$^{-1}$ |
|---|---|---|---|
| Type | Value | temperature coefficient ppm °C$^{-1}$ | |
| ferrite core coil | 300 μH | +100 | +100 |
| silver mica capacitor | 15000 pF | +25 | +25 |
| ceramic capacitor | 330 pF | −5000 | −125 |

The temperature coefficient of the tuned circuit is then 0 ppm °C$^{-1}$ (parts per million per degree centigrade).

The need to add an extra capacitor for temperature compensation increases the manufacturing cost of the tuned circuit and of course each one of these components has a manufacturing tolerance. Therefore in order to achieve good temperature coefficient compensation it is necessary to select a ceramic capacitor having the correct negative temperature coefficient for a particular batch of ferrite cores. Alternatively, ceramic capacitors having the same negative temperature coefficient are used and different capacitor values are selected.

A more satisfactory method of overcoming this difficulty would be to find some way of constructing a magnetic core assembly in which the inductance is not significantly affected by temperature changes. The present invention was devised in an attempt to find a solution to this problem.

Therefore, the core body according to the invention is characterized in that the non-magnetic member consists of a thin metal plate which is held in intimate contact with a surface of the core.

Figure 2:
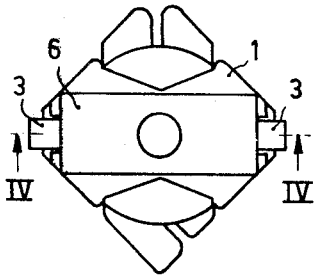
Figure 3:
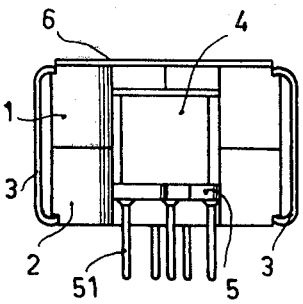
Figure 4:
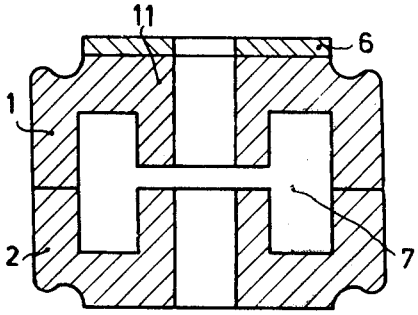
Figure 5:
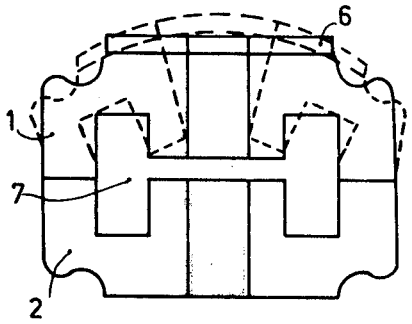
Figure 6:
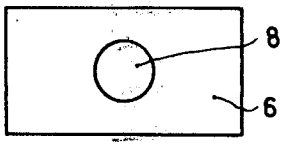
Figure 7:
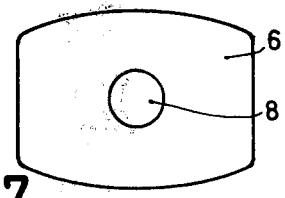
Figure 8:
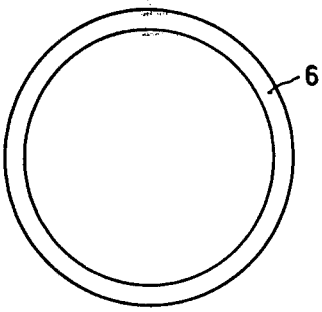
Figure 9:
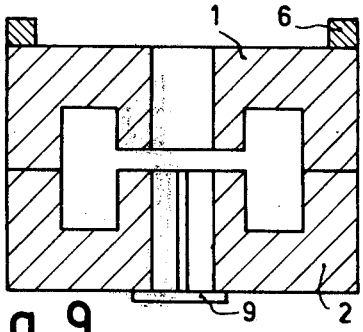

A number of embodiments according to the invention will be described in detail hereinafter with reference to the accompanying drawings, in which:

FIGS. 1, 2 and 3 show respectively a perspective view, plan view and side elevation of one embodiment of a core body according to the invention, FIG. 4 is an axial cross-sectional view on an enlarged scale of the core parts taken along the line IV—IV in FIG. 2, FIG. 5 is similar to FIG. 4 and shows in an exaggerated manner the effect on the core parts of a rise in temperature, FIGS. 6, 7 and 8 are different examples of temperature-compensating members, and FIG. 9 is an axial cross-sectional view of a core including a temperature-compensating member in the form of an annulus.

Type of the core body chosen for the embodiments of FIGS. 1 to 8 had an effective magnetic path length of 25.6 mm and an effective magnetic volume of 810 mm.

As appears from FIGS. 1 to 3, the core body comprises an upper core part 1 and a corresponding lower core part 2 of ferrite material which are clamped together by means of spring clips 3. A coil winding 4 carried on a coil former is placed between the core parts before the clamping operation, and the connections from the windings are made to connecting pins 51 supported on a tag board 5 which forms part of the coil former.

FIG. 4 is an enlarged cross-sectional view along the line IV—IV in FIG. 2.

A brass strip 6 is secured to the outside surface of the upper core part 1 utilizing means which ensure a stable joint without creep or relaxation. The means used in this instant was an epoxy resin adhesive. Since the brass strip has a different coefficient of linear expansion from that of the ferrite material this construction is comparable to that of a bimetal. The core includes an air gap 7 which is formed by grinding away some of the tubular central portion 11 of the core part 1.

FIG. 5 shows in an exaggerated manner the resulting effect on the core parts caused by a rise in temperature. The broken lines denote the distortion produced in the upper core part 1 by the expansion of the member 6. One effect of the distortion is to cause the air gap 7 to lengthen, and this has the effect of reducing the inductance of the coil, thus reducing the temperature coefficient of inductance.

In a first series of experiments, the width of the brass strip was kept constant at 6.8 mm and the length of the strip was varied. The tests were first made on an ordinary coil without the member 6, and the tests were repeated after the member had been fixed in place.

The results obtained were as follows:

| Coil number | Length of member in mm | temperature coefficient of inductance in ppm °C⁻¹ | |
|---|---|---|---|
| | | without member | with member |
| 1 | 7.0 | 109 | 49 |
| 2 | 8.0 | 120 | 43 |
| 3 | 9.0 | 118 | 18 |
| 4 | 10.0 | 123 | 28 |
| 5 | 11.0 | 105 | 8 |

For a second series of experiments, the width of the member was kept constant at 6.8 mm and the length of the member was also constant at 11.0 mm. The purpose of this series was to determined the reproducibility of the effect of the member on the temperature coefficient of inductance of the overall assembly.

The results obtained were as follows:

| Coil number | Temperature coefficient of inductance in ppm °C⁻¹ | |
|---|---|---|
| | without member | with member |
| 6 | 109 | 6 |
| 7 | 99 | 5 |
| 8 | 103 | −3 |
| 9 | 114 | 17 |
| 10 | 125 | 21 |

In both series the temperature coefficient measured with the metal member on the core was found to be stable with temperature cycling.

The use of brass for the material of the member 6 was found to be attractive because this metal expands in a regular fashion and it has a higher coefficient of linear expansion than that of ferrite. It therefore enables the temperature coefficient of inductance of the core assembly to be reduced in a controlled way. It would alternatively be possible to use a material for the member 6 which has a lower coefficient of linear expansion than that of ferrite, and in this case the air gap would tend to contract so that the temperature coefficient of the inductance would still vary in a predetermined manner. A construction of this kind might be attractive in an electrical circuit desired for an application where temperature sensitivity is required.

FIG. 6 is a plan view of the temperature-compensating member 6 which has made from a short length of this brass strip material. If the core body is intended to be used for a transformer pot core, the member 6 may be just a plain rectangle of brass.

However, if the core body is used for a variable coil, the member 6 should preferably include a central hole 8 which, during the construction of the core body, is aligned with the central hole of the core. After the usual inductance adjuster has been inserted in the coil, the hole 8 will allow this adjuster to be reached with a non-magnetic adjusting tool so that the normal adjustment procedure can be carried out.

FIG. 7 shows an alternative embodiment of the temperature-compensating member 6 which was designed in such a way that the cross-sectional area is approximately uniform along the length of the strip.

FIG. 8 shows a further embodiment of the member 6 in the form of an annulus. This embodiment is particularly suitable for use with pot-type core bodies in which the coil former is completely enclosed by the core parts. With this type of core body, the cross-section in any plane through the core axis is the same.

FIG. 9 is a cross-sectional view of such a pot-core in which a member 6, in the form of the annulus of FIG. 8, has been secured around the periphery of the upper core part 1. Instead of being joined together by means of clamps, the two core parts 1, 2 in this instance have been adhesively joined and the same adhesive has been used to fix the member 6 in place. A member 6 in the form of an annulus works in a similar way to the flat strip shaped member and causes similar distortion of the upper core part as that shown in FIG. 5. The use of the annular member 6 is believed to be more suitable for an application in which the pot-core is axially symmetrical.

The pot core of FIG. 9 includes a brass nut 9 which is cemented to the lower core part and which can cooperate with an adjuster for adjustment of the reluctance of the core thus formed. In a different embodiment, it would be possible to use a different form of adjustment of the core. If the core is used in a transformer, an adjuster need not be provided in some cases.

The foregoing descriptions of the embodiments of the invention have been given merely by way of example, and a number of modifications may be made without departing from the scope of the invention. For instance, it is not essential that the temperature-compensating member should be secured to only one of the two core parts because in some applications both core parts can carry a compensating member. The invention is not limited to its use for core bodies of ferrite material; other compositions of a different suitable magnetic core material such as magnetic alloys can also be used. An alternative adhesive suitable for securing a brass strip to a ferrite material is a polydiacrylic ester adhesive. If there is sufficient room within the hollow interior of the core, the temperature-compensating member can alternatively be fitted internally instead of being attached to the outside of the core.

What is claimed is:

1. A core body for a coil means, comprising a core including two core members composed of ferromagnetic material which are fixed together so that an air gap is defined between two surfaces of the core members, a non-magnetic member comprising a thin metal plate having a temperature coefficient of expansion which differs from that of the ferromagnetic core material, said non-magnetic member being held in intimate contact with a surface of the core and located outside of the main flux path of the core body and arranged such that the resulting different coefficients of expansion cause a variation of the length of said air gap with temperature to thereby adjust the reluctance of the core as a function of the temperature.

2. A core body as claimed in claim 1, characterized in that the non-magnetic metal plate member has a strip-like shape and further comprising means independent of said metal plate member for clamping said first and second core members together to restrain relative axial movement therebetween.

3. A core body as claimed in claim 1, characterized in that the nonmagnetic member is annular.

4. A core body as claimed in claim 1 wherein the non-magnetic metal plate member is cemented to the core so that differential rates of thermal expansion between the metal plate and the core cause a deformation of the shape of one core member to cause said variation in the length of said air gap.

5. An inductor comprising first and second core members composed of ferromagnetic material having a temperature coefficient of expansion, said core members being disposed in axial alignment and fixed together so as to define a magnetic circuit including an air gap between two opposed surfaces of the core members, a winding coupled to at least one of said core members, a nommagnetic member comprising a thin plate having a different temperature coefficient of expansion than that of the ferromagnetic core material, and means for fixing said thin plate in intimate contact with a surface of at least one core member so that the different temperature coefficients of expansion of the core material and the plate material cause the length of said air gap to vary with temperature and thereby adjust the core reluctance as a function of temperature.

6. An inductor as claimed in claim 5 wherein the plate is composed of a metal material having a temperature coefficient of the same polarity as that of the core material.

7. An inductor as claimed in claim 5 wherein the plate is composed of brass and the core members are composed of ferrite material.

8. An inductor as claimed in claim 5 wherein the plate is composed of a metal material and the first and second core members further define an axial cylindrical channel, said plate including a hole axially aligned with said channel.

9. An inductor as claimed in claim 5 wherein the plate is composed of a metal material and has an annular shape.

10. An inductor as claimed in claim 5 wherein the plate is composed of a metal material and each of the core members includes a tubular central part, said tubular parts being in axial alignment with confronting surfaces forming said air gap, and said thin metal plate is fixed to an outer surface of one of said core members which outer surface is perpendicular to the axis of the tubular part.

* * * * *

UNITED STATES PATENT AND TRADEMARK OFFICE

CERTIFICATE OF CORRECTION

PATENT NO. : 3,947,794
DATED : March 30, 1976
INVENTOR(S) : CLIVE VICTOR NEWCOMB It is certified that error appears in the above-identified patent and that said Letters Patent are hereby corrected as shown below:

Col. 2, line 13, in the table cancel "-5000" and insert -- -5600 --;

line 21, after "Therefore" insert a comma (,);

line 57, cancel "Type" and insert -- The type --; cancel "the" (1st occurr.);

line 59, change "810 mm" to -- 810 $mm^3$ --;

Signed and Sealed this

Fourteenth Day of September 1976

[SEAL]

*Attest:*

RUTH C. MASON
*Attesting Officer*

C. MARSHALL DANN
*Commissioner of Patents and Trademarks*